US008180090B2

(12) United States Patent
Hupkes

(10) Patent No.: US 8,180,090 B2
(45) Date of Patent: May 15, 2012

(54) HEADSET WITH EXCHANGEABLE SPEAKER

(75) Inventor: Ernst Hupkes, Kampen (NL)

(73) Assignee: Sony Ericsson Mobile Communications AB, Lund (SE)

( * ) Notice: Subject to any disclaimer, the term of this patent is extended or adjusted under 35 U.S.C. 154(b) by 1404 days.

(21) Appl. No.: 11/747,268

(22) Filed: May 11, 2007

(65) Prior Publication Data

US 2008/0279409 A1 Nov. 13, 2008

(51) Int. Cl.
*H04R 25/00* (2006.01)

(52) U.S. Cl. ..... 381/370; 381/374; 381/379; 473/433

(58) Field of Classification Search ..... 381/322
See application file for complete search history.

(56) References Cited

U.S. PATENT DOCUMENTS 4,791,673 A 12/1988 Schreiber
5,412,736 A 5/1995 Keliiliki
6,021,195 A * 2/2000 Brawne et al. ..... 379/433.02
7,672,469 B2 * 3/2010 Dyer et al. ..... 381/322
2005/0259812 A1 11/2005 Chen
2006/0067555 A1 3/2006 Tsai

FOREIGN PATENT DOCUMENTS

GB 2 426 140 11/2006

OTHER PUBLICATIONS

International Search Report of International Application No. PCT/IB2007/003084, filed Oct. 16, 2007.
Written Opinion of the International Searching Authority dated Feb. 27, 2008 for International Application No. PCT/IB2007/003084, filed Oct. 16, 2007.

* cited by examiner

*Primary Examiner* — Davetta W Goins
*Assistant Examiner* — Amir Etesam
(74) *Attorney, Agent, or Firm* — Renner, Otto, Boisselle & Sklar, LLP

(57) ABSTRACT

An earpiece speaker system including an earpiece body through which an audio signal is provided, the earpiece body having a speaker mount surface, and a plurality of speaker modules mountable to the body. Each of the speaker modules includes a mount surface for mating with the earpiece body speaker mount surface for securing the speaker module thereto in order to reproduce the audio signal.

12 Claims, 3 Drawing Sheets

HEADSET WITH EXCHANGEABLE SPEAKER

TECHNICAL FIELD OF THE INVENTION

The present invention relates generally to portable electronic devices, and more particularly to headsets for use with portable electronic devices.

DESCRIPTION OF THE RELATED ART

Portable electronic devices have been popular for decades yet continue to increase in popularity. Many modern portable electronic devices are intended or suitable for recording or playback of acoustic and/or video signals. For example, portable CD or DVD players, MPEG players, MP-3 players, etc. provide a vast variety of forms of personal entertainment. Whether audio and/or video entertainment, there are numerous portable electronic devices to satisfy any user's tastes.

Similarly, portable electronic devices in the form of mobile phones, pagers, communicators, e.g., electronic organizers, personal digital assistants (PDAs), smartphones or the like are also increasingly popular. Such devices allow a user to communicate with others, store and manipulate data, create text, etc., many times within the same device.

For many portable electronic devices, it is necessary or desirable to have a headset, the headset typically comprising one or more speakers, which may be in the form of one or two earplugs. Typical headsets are either wireless (e.g., Bluetooth or the like) or wired. By using a headset, a user of a mobile phone, for example, can enjoy more privacy such that the others around him or her cannot hear the telephone conversation. Further, by using a suitable microphone in the headset, a telephone call can still be successfully arrived at even though there may be much background noise.

There are a wide variety of headset types, including over-ear headsets, around-ear headsets, on ear headsets, in-concha headsets, in-ear headsets, etc. Each type of headset has advantages and disadvantages with regard to sound quality, ease of use, aesthetics, user comfort, etc.

Two popular headset designs, particularly for headsets used in connection with mobile phones, are the in-concha headset and the in-ear headset. The in-concha headset design generally includes a speaker that is, when properly positioned, received within the concha of the ear of a user (generally the area of the ear surrounding the opening of the ear canal). The in-ear headset design generally includes a speaker and/or insert that is at least partially received within the ear canal of a user when properly positioned. These designs are typically compact and are often supported by a small structure that is secured to the external portion of the ear (e.g., with an ear hook) and/or supported and/or retained within the ear by the concha or ear canal in what amounts to an interference fit. Accordingly, the in-concha and in-ear designs are relatively low profile and unobtrusive, while still providing quality sound.

Many users of both the in-concha and in-ear types headsets may experience discomfort after a period of time of use. The discomfort can be due to the fitment of the headset, the type of material of which the headset is composed, or simply sensitive ears. Often the onset of discomfort is delayed and, accordingly, not apparent to the user when the user tests the headset prior to purchase. Thus, a user may purchase a given design of headset only to later realize that the design is uncomfortable and/or not well suited to the users needs.

SUMMARY

In view of the aforementioned shortcomings, there is a strong need in the art for a headset that can be easily converted between various design types (i.e., in-concha headsets, in-ear headsets, etc.) by an end user.

According to an aspect of the invention, an earpiece speaker system comprises an earpiece body through which an audio signal is provided, the earpiece body having a speaker mount surface, and a plurality of speaker modules interchangeably mountable to the body. Each of these speaker modules includes a mount surface for mating with the earpiece body speaker mount surface for securing the speaker module thereto in order to reproduce the audio signal.

According to another aspect of the invention, the earpiece body includes electrical contacts for making an electrical connection with the speaker module when mounted thereto, the electrical contacts configured to provide a suitable audio signal to a speaker of the speaker module.

According to another aspect of the invention, the earpiece body includes at least two pairs of electrical contacts, each respective pair for use with a respective different type of speaker module.

According to another aspect of the invention, the at least two pairs of electrical contacts are formed by three electrical contacts.

According to another aspect of the invention, the earpiece system further comprises a fastener for securing a speaker module to the earpiece body.

According to another aspect of the invention, the plurality of speaker modules in the earpiece system includes at least one in-ear speaker module and at least one in-concha speaker module.

According to another aspect of the invention, a first pair of electrical contacts are configured to provide a suitable electrical signal to the in-ear speaker module when mounted thereto, and a second pair of contacts are configured to provide a suitable signal to the in-concha speaker module when mounted thereto.

According to another aspect of the invention, an earpiece body comprises a mount surface for receiving a speaker module, a first pair of electrical contacts for providing a suitable electrical signal to a first speaker module type, and a second set of electrical contacts for providing a suitable electrical signal to a second speaker module type.

According to another aspect of the invention, the first and second pairs of electrical contacts are formed by three electrical contacts.

According to another aspect of the invention, an earpiece comprises the earpiece body and a speaker module mounted thereto.

According to another aspect of the invention, an earpiece speaker comprises an earpiece body through which an audio signal is provided, a speaker for reproducing the audio signal, and a plurality of ear inserts removably attachable to the at least one of the earpiece body and the speaker, wherein the plurality of ear inserts include at least one in-ear insert and at least one in-concha insert.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

It should be emphasized that the term "comprises/comprising" when used in this specification is taken to specify the presence of stated features, integers, steps or components but does not preclude the presence or addition of one or more other features, integers, steps, components or groups thereof.

DETAILED DESCRIPTION OF EMBODIMENTS

The present invention will now be described with reference to the figures, in which like reference labels are used to refer to like elements throughout.

Figure 1:
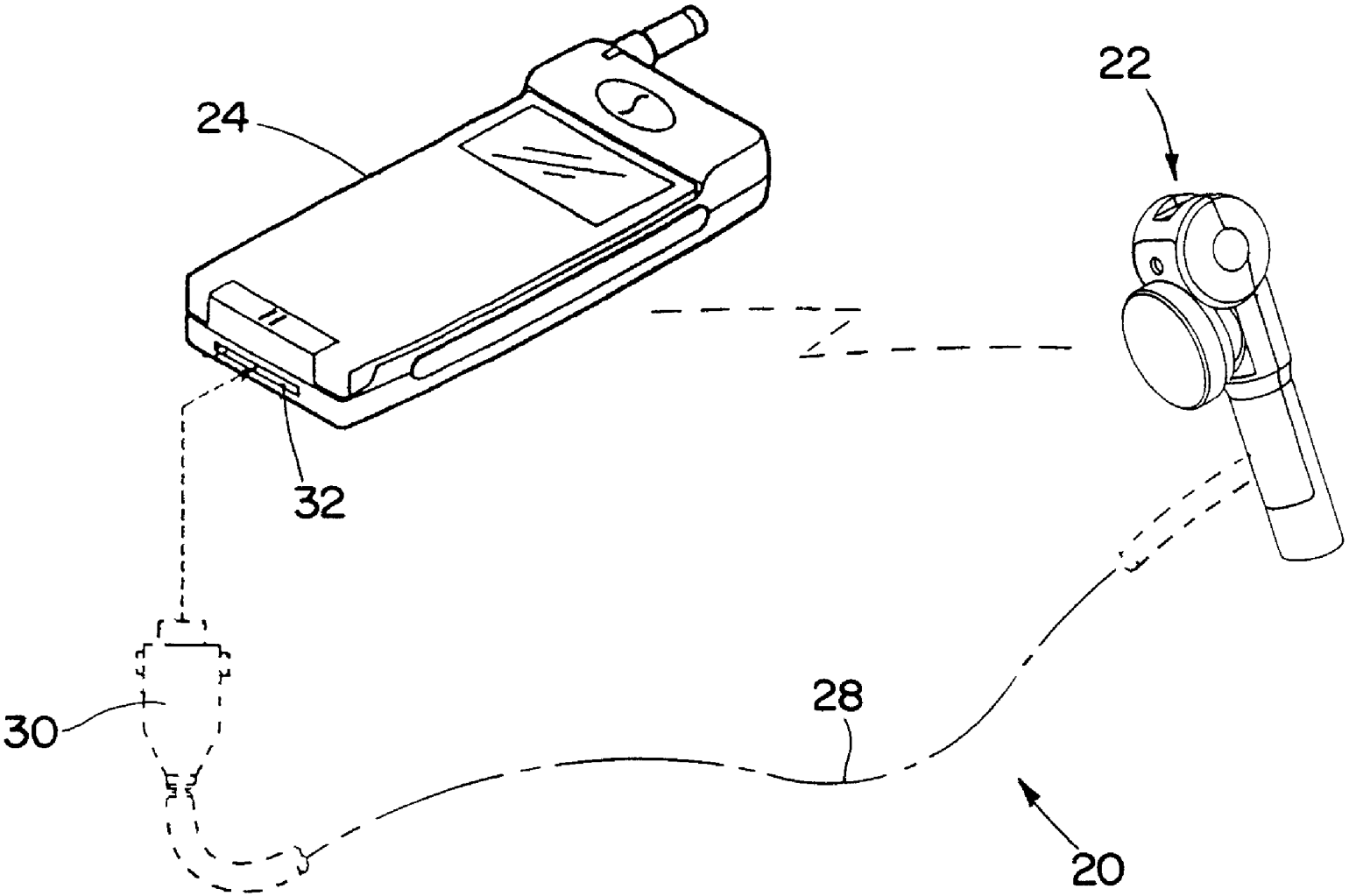
FIG. 1 is a perspective view of a mobile phone and a headset having an earpiece speaker system in accordance with an exemplary embodiment of the invention.

FIG. 1 illustrates an exemplary headset 22 including an earpiece in accordance with the invention. The headset 22 is connectable to a portable electronic device, such as mobile phone 24, by a wireless connection (e.g., Bluetooth or the like) or via a cord 28 and connector 30. The connector 30 can be configured to be removably connectable to the mobile phone 24 via a corresponding connector 32 included within the mobile phone 24. The headset 22 illustrated in FIG. 1 is merely exemplary in nature and is but one type of headset that can be used in conjunction with the earpiece system of the preset invention.

When connected to the phone 24, either by a wired connection or a wireless connection, the headset 22 allows a user of the mobile phone 24 to experience personal hand-free (PHF) communications with someone at the other end of a call. Again, the illustrated headset 22 is merely exemplary in nature and other headsets can be used in accordance with the invention, such as headsets commonly used with portable MP3 player, etc.

Turning now to FIGS. 2-6, and in accordance with the invention, an earpiece speaker system 40 is illustrated. The earpiece speaker system 40 illustrated in FIGS. 2-6 features an earpiece body 42 and a plurality of exchangeable speaker modules that allow the earpiece speaker system 40 to function as either an in-concha earpiece or an in-ear earpiece as part of the aforementioned headset 22. The speaker modules are easily exchangeable such that a user can exchange speaker modules as desired.

Figure 2:
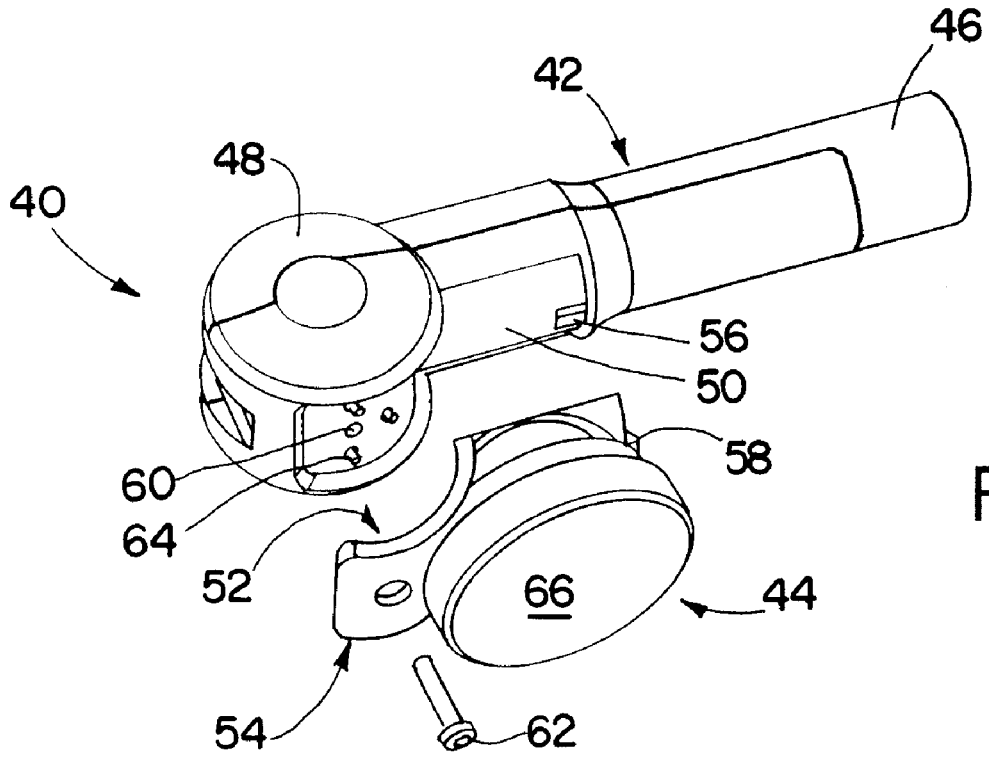
FIG. 2 is a perspective assembly view of an earpiece speaker system including an in-concha speaker module in accordance with an exemplary embodiment of the invention.
Figure 3:
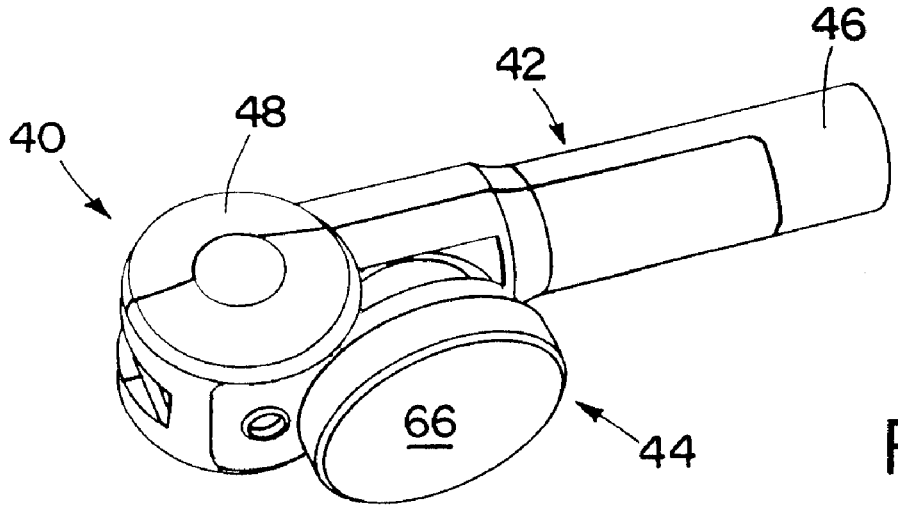
FIG. 3 is a perspective view of the assembled earpiece speaker system of FIG. 2.

In FIGS. 2 and 3, the earpiece speaker system 40 is equipped with an in-concha speaker module 44. It will be appreciated that an in-concha speaker module 44, when properly worn, rests about the opening of a user's ear canal. The earpiece speaker system 40 includes an earpiece body 42, through which an audio signal is provided (e.g., via the hard wire cord 28 or wireless connection), and the speaker module 44 mounted thereto. The earpiece body 42 has a generally cylindrical stem portion 46 and a head portion 48, although virtually any shape may be used as will be appreciated. The earpiece body 42 and speaker module 44 can be made of any suitable material such as metal, plastic, or a plastic composite, for example.

A speaker module mount surface 50 extends between the stem portion 46 and the head portion 48 and is configured to mate with a corresponding mount surface 52 of a mount portion 54 of the speaker module 44. The speaker module mount surface 50 is recessed slightly within the earpiece body 42 such that when the speaker module 44 is installed, the mount portion 54 is generally flush with an outer surface of the earpiece body. The speaker module mount surface 50 of the earpiece body 42 includes an opening or recess 56 for receiving a protrusion, such as hook 58, that extends from the mount portion 54 of the speaker module 44. The recess 56 and hook 58 cooperate to retain the speaker module 44. A threaded bore 60 in the head portion 48 of the speaker module mount surface 50 is adapted to receive a fastener, such as a screw 62, for releasably securing the speaker module 44 to the earpiece body 42. It will be appreciated that other ways of securing the speaker module 44 to the earpiece body 42 can be used such as, for example, an adhesive, a magnetic coupling, a hook and loop type fastener (e.g., Velcro), snap fit, etc.

The illustrated earpiece body 42 has three electrical contacts 64 for making an electrical connection with the speaker module 44 for transmitting audio signals thereto when the speaker module 44 is mounted to the earpiece body 42. The electrical contacts 64 are configured to provide a suitable audio signal to the speaker module 44 for reproduction by a speaker 66 of the speaker module 44. Accordingly, the electrical contacts 64 are configured to make contact with electrical contacts on the mount surface 52 of speaker module 44. Such speaker module contacts are not visible in FIG. 2 or 3.

Figure 4:
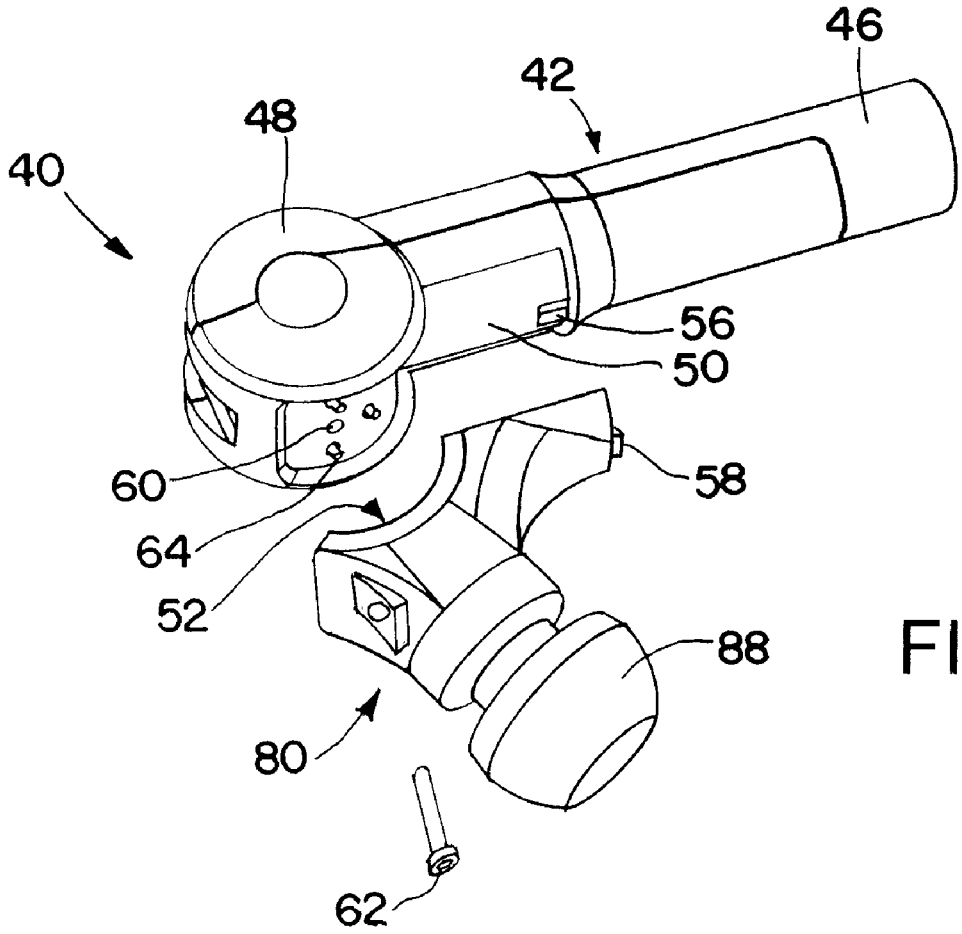
FIG. 4 is a perspective assembly view of an earpiece speaker system including an in-ear speaker module in accordance with an embodiment of the invention.
Figure 5:
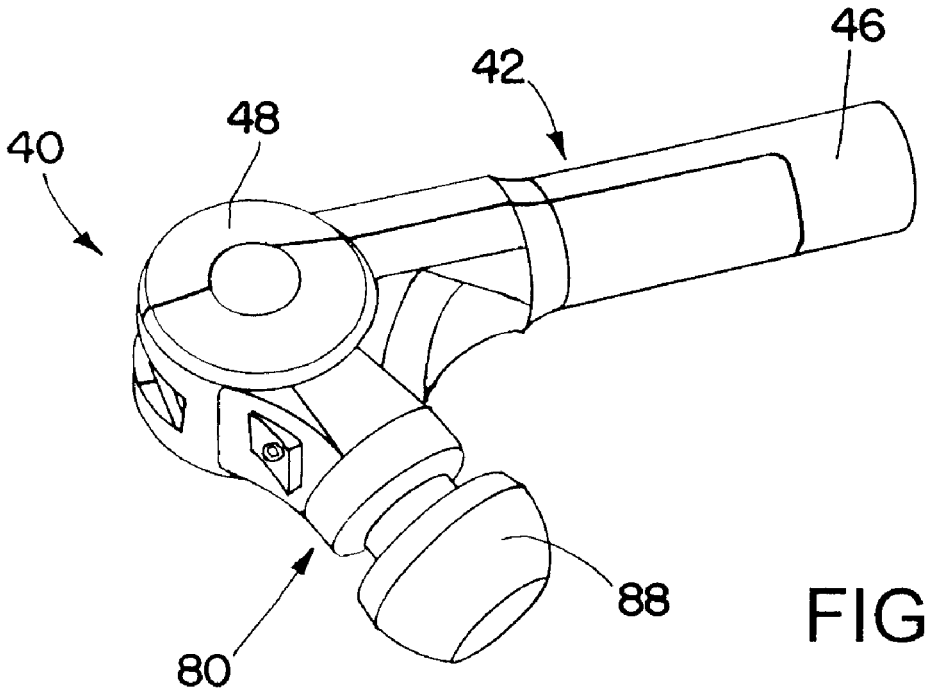
FIG. 5 is a perspective view of the assembled earpiece speaker system of FIG. 4.

Turning now to FIGS. 4 and 5, the earpiece speaker system 40 is shown equipped with an in-ear speaker module 80. The in-ear speaker module 80, when properly worn, extends at least partially into an ear canal of a user. The earphone speaker system 40 in FIGS. 4 and 5 is generally identical to the earphone speaker system 40 in FIGS. 2 and 3, except that the in-ear speaker module 80 has replaced the in-concha speaker module 44.

As mentioned, the speaker modules are easily exchangeable. Accordingly, the in-ear speaker module 80 has a mounting surface 82 that is essentially identical to the mounting surface 52 of the in-concha speaker module 44. As such, the mounting surface 82 is configured to mate with the speaker module mount surface 50 of the earpiece body 42. Speaker module 80 is installed on the earpiece body 42 in the same manner as speaker module 44 and thus, hook 58 cooperates with recess 56 to secure the speaker module 80 to the earpiece body 42 at a first location, while a fastener, screw 62, secures the speaker module 80 to the head portion 48 of the earpiece body 42. Accordingly, it will be appreciated that exchanging the speaker modules is merely a matter of removing screw 62, detaching speaker module 44 from the earpiece body 42, and installing speaker module 80 in place of speaker module 44.

It will be appreciated that other ways of securing the speaker modules 44 and 80 to the earpiece body can be employed. For example, the speaker modules 44 and 80 and/or the earpiece body 22 can be configured to connect via a snap fit, for example.

In FIG. 5 the earpiece speaker system 40 is illustrated with the speaker module 80 secured to the earpiece body 42. As will be appreciated, the speaker module 80 includes an ear canal insert tip 88 (e.g., ear rubber) that is insertable at least partially into an ear canal of a user. The ear canal tip 88 is typically made of a soft and/or flexible material, such silicone or rubber, to provide a snug yet comfortable fit when the tip is inserted into the ear canal. It will be appreciated that the ear canal tip 88 can be removably attachable to the speaker module 80 so that a user can exchange ear canal tips of various sizes and of different materials for maximum flexibility and comfort.

It will be appreciated that depending on whether the in-concha speaker module 44 or in the in-ear speaker module 80 is installed on the earpiece body 42, it may be desirable to provide different audio signals to each respective speaker module. By way of example, it may be desirable to provide an audio signal to the in-concha speaker module 44 that provides greater bass response, as such tones are more likely to attenuate and/or be dispersed prior to reaching a user's eardrum when using the in-concha speaker module 44. In contrast, when using the in-ear speaker module 80 which generally seals against the user's ear canal and, therefore, usually directs all audio to the user's eardrum, an audio signal having less bass response may be appropriate. In addition, or in the alternative, other forms of different audio processing may be appropriate depending on whether the in-concha speaker module 44 or the in-ear speaker module 80 is utilized.

In order to provide different processing of the audio signals to the in-concha speaker module 44 and the in-ear speaker module 80, it is desirable to enable the earpiece speaker system 40 to identify which speaker module 44 or 80 is mounted to the earpiece body 42. For example, the aforementioned set of three electrical contacts 64 is provided on the earpiece body 42. The in-concha speaker module 44 utilizes a first pair of the three electric contacts 64 when installed on the earpiece body 42. The in-ear speaker module 80 utilizes a second, different pair of speaker contacts 64 when installed on the earpiece body 42. Based on the load presented across the respective pairs of contacts, the audio processing circuitry (not shown) is able to detect which particular speaker module 44 or 80 is mounted to the earpiece body 42. Accordingly, it will be appreciated that suitable audio processing circuitry, either in the, for example, earpiece body 42 or in the portable electronic device, or both, can be provided to sense which speaker module 44 or 80 is attached to the earpiece body 42, and provide a suitable audio signal to the attached speaker module via the relevant electrical contacts 64, etc. In this regard, each earpiece module can include an electronic identifier that can be read by the audio processing circuitry when the earpiece module is installed on the earpiece body 42. Similarly, different earpiece module types can have different impedances that can be detected by the audio processing circuitry, for example.

It will now be appreciated that the earpiece speaker system 40 as described offers a user the ability to switch between an in-concha type earpiece speaker system and an in-ear type earpiece speaker system with relative ease and without the need to configure or otherwise adjust the audio signal provided to the earpiece speaker system. Accordingly, the earpiece speaker system 40 provides enhanced functionality to a user by allowing the user to select the type of earpiece desired based on comfort or a particular application.

It will also be appreciated that other types of speaker modules, in addition to the in-ear type and in-concha type, can be provided. Further, the use of speaker modules that are mountable to the earpiece body allows a plurality of speaker modules to be designed such that a user can customize the earpiece speaker system as desired. Various speaker modules can be provided of not only various design types (e.g. in-concha, in-ear, etc.), but also with speakers of varying quality and/or having various other features, for example. Further, as advancements are made in speaker technology, a user can upgrade the earpiece speaker system with a speaker module having the latest technology, without having to replace the entire headset or earpiece speaker system.

Although the invention has been shown and described with respect to certain preferred embodiments, it is obvious that equivalents and modifications will occur to others skilled in the art upon the reading and understanding of the specification. The present invention includes all such equivalents and modifications, and is limited only by the scope of the following claims.

The invention claimed is:

1. An earpiece speaker system comprising:

an earpiece configured to provide personal hands-free (PHF) communications, wherein the earpiece is not mounted to a communications device but is removably electrically connectable to the communications device via at least one of a cord and connector combination, or a wireless connection;

wherein the earpiece includes:

an earpiece body through which an audio signal is providable, the earpiece body having a first mount surface and a first set of electrical contacts; and a plurality of speaker modules interchangeably mountable to the earpiece body, wherein each of the speaker modules includes a second mount surface for mating with the first mount surface for securing the speaker module to the earpiece body and wherein each of the speaker modules includes a second set of electrical contacts configured to mate with the first set of electrical contacts in order for the speaker module to reproduce the audio signal, wherein the plurality of speaker modules includes at least one in-ear type speaker module and at least one in-concha type speaker module.

2. An earpiece speaker system as set forth in claim 1, Wherein the first set of electrical contacts and the second set of electrical contacts configured to provide a suitable audio signal to a speaker of the speaker module, wherein audio processing of the suitable audio signal differs depending on which of the in-ear type speaker module or the in-concha type speaker module is mounted to the earpiece body.

3. An earpiece system as set forth in claim 2, wherein the earpiece body includes at least two pairs of electrical contacts, each respective pair for use with a respective different type of speaker module.

4. An earpiece system as set forth in claim 3, wherein the at least two pairs of electrical contacts are formed by three electrical contacts.

5. An earpiece system as set forth in claim 1, further comprising a fastener for securing a speaker module to the earpiece body.

6. An earpiece system as set forth in claim 1, wherein the first set of electrical contacts includes a first pair of electrical contacts configured to provide a suitable electrical signal to the in-ear speaker module when mounted thereto, and a second pair of contacts configured to provide a suitable signal to the in-concha speaker module when mounted thereto.

7. An earpiece speaker system as set forth in claim 1, wherein the first mount surface has a recess or protraction for mating with a corresponding recess or protrusion on the second mounting surface when mounted thereto.

8. A headset including the earpiece speaker system as set forth in claim 1.

9. An earpiece configured to provide personal hands-free (PHF) communications, the earpiece comprising:

an earpiece body through which an audio signal is provided, wherein the earpiece body is not mountable to a communications device but is removably electrically connectable to the communications device via at least one of:

a cord and connector combination, or a wireless connection;

a speaker for reproducing the audio signal; and wherein the earpiece body is removably attachable to multiple types of speaker modules,that provide the speaker, wherein the multiple types of speaker modules include at least one in-ear type speaker module and at least one in-concha type speaker module.

10. The earpiece speaker system of claim 2, wherein bass response of the suitable audio signal differs depending on which of the in-ear type speaker module or the in-concha type speaker module is mounted to the earpiece body.

11. The earpiece of claim 9, wherein audio processing of the audio signal differs depending on which of the in-ear type speaker module or the in-concha type speaker module is attached to the earpiece body.

12. The earpiece of claim 9, wherein bass response of the audio signal differs depending on which of the in-ear type speaker module or the in-concha type speaker module is attached to the earpiece body.

* * * * *